US007000638B2

(12) United States Patent
Tseng et al.

(10) Patent No.: US 7,000,638 B2
(45) Date of Patent: Feb. 21, 2006

(54) DIVERTER VALVE WITH MULTIPLE VALVE SEAT RINGS

(75) Inventors: Raymond R. Tseng, Chandler, AZ (US); Bruce Larsen, Glendale, AZ (US)

(73) Assignee: Honeywell International. inc., Morristown, NJ (US)

( * ) Notice: Subject to any disclaimer, the term of this patent is extended or adjusted under 35 U.S.C. 154(b) by 153 days.

(21) Appl. No.: 10/765,669

(22) Filed: Jan. 26, 2004

(65) Prior Publication Data

US 2005/0263194 A1 Dec. 1, 2005

(51) Int. Cl.
*F15C 1/12* (2006.01)

(52) U.S. Cl. ..... 137/819; 137/831; 137/832; 137/872; 137/112; 137/118.06; 251/368; 244/3.22

(58) Field of Classification Search ..... 137/112, 137/118.06, 625.33, 819, 831, 832, 872; 251/368; 244/3.22
See application file for complete search history.

(56) References Cited

U.S. PATENT DOCUMENTS

| | | | | | |
|---|---|---|---|---|---|
| 2,627,388 | A | * | 2/1953 | Andrew et al. | 137/113 |
| 2,884,944 | A | | 5/1959 | Giles | |
| 3,151,623 | A | * | 10/1964 | Riordan | 137/112 |
| 3,168,898 | A | | 2/1965 | Samet | |
| 3,486,517 | A | * | 12/1969 | Gaura | 137/832 |
| 3,520,479 | A | | 7/1970 | Jacquin et al. | |
| 3,521,653 | A | * | 7/1970 | Zoya et al. | 137/831 |
| 3,749,357 | A | | 7/1973 | Fowler | |
| 3,949,774 | A | | 4/1976 | Morrow | |
| 4,413,795 | A | * | 11/1983 | Ryan | 244/3.22 |
| 5,927,335 | A | * | 7/1999 | Christensen | 137/821 |
| 6,926,036 | B1 | * | 8/2005 | Christensen | 137/872 |

* cited by examiner

*Primary Examiner*—A. Michael Chambers
(74) *Attorney, Agent, or Firm*—Ingrassia Fisher & Lorenz

(57) ABSTRACT

A diverter valve includes a valve bore having a set of valve seats associated with each fluid outlet port. Each set of valve seats is at least partially separated from one another by a flow channel. The valve seat configuration increases the impact area for the valve element. As a result, the impact force upon seating against the valve seats is reduced. Moreover, by including flow channels between the sets of valve seats, the switching force and performance of the valve element is not adversely affected.

20 Claims, 2 Drawing Sheets

DIVERTER VALVE WITH MULTIPLE VALVE SEAT RINGS

FIELD OF THE INVENTION

The present invention relates to hot gas diverter valves used in missile and spacecraft propulsion systems and, more particularly, to a hot gas diverter valve having multiple valve seat rings.

BACKGROUND OF THE INVENTION

The movements involved in flight of some missiles and space vehicles, such as pitch, yaw, and spin rate, are controlled with flight control systems that use reaction jets. In some systems of this type, a pressurized gas source, such as a gas generator, supplies a pressurized gas to one or more fluidic amplifier stages. In response to a control signal supplied from flight control equipment, a fluidic amplifier stage can selectively divert the pressurized gas into one of two or more flow paths. Each flow path may have a nozzle on its outlet that is located external to the missile or vehicle. These nozzles may be positioned to provide thrust in different or opposite directions. Thus, the fluidic amplifier stages can affect one or more flight parameters by selectively diverting the pressurized gas to selected outlet nozzles.

The fluidic amplifier stages incorporated into the above-described flight control system can include non-vented fluidic amplifiers, which are generally known in the art. However, non-vented fluidic amplifiers may not provide 100% flow diversion. Thus, some systems incorporate an additional element, such as a diverter valve, between the final fluidic amplifier stage and the output nozzles, which allows the system to substantially achieve 100% flow diversion.

One particular type of diverter valve includes a valve element that located in a valve bore formed in the valve housing. The housing includes an inlet port and two outlet ports. The housing additionally includes two valve seats that each surrounds one of the two outlet ports. The valve element is moveable within the valve bore, and selectively seats against one of the two valve seats, and thereby blocks one of the two ports so that pressurized gas entering the inlet port is selectively directed out the port that is not blocked. For high-temperature applications, such as those that may be encountered in missile and spacecraft propulsion systems, refractory metals, such as rhenium, and carbon-based materials, such as graphite, may be used to construct the valve element. In some cases, rhenium coated graphite valve elements are used.

Although the above-described type of diverter valve is robustly designed and manufactured, and operates safely, it suffers certain drawbacks. For example, to provide the desired switching performance of the valve element, a relatively small valve-element-to-seat contact area is included in the valve. However, the relatively small contact area can, in many instances, result in the valve element experiencing an impact load during operation that is concentrated on a relatively small area of the valve element. This concentrated impact load can damage the valve element, which can adversely impact system performance, shorten valve element lifetime, and/or reduce overall system reliability.

Hence, there is a need for a diverter valve that addresses one or more of the above-noted drawbacks. Namely, a hot gas diverter valve having a valve element that experiences reduced impact loading during operation, and thus does not adversely impact system performance, and/or does not shorten valve element lifetime, and/or enhances overall system reliability. The present invention addresses one or more of these needs.

SUMMARY OF THE INVENTION

The present invention provides a hot gas diverter valve with multiple valve seats. The multiple valve seat configuration reduces the impact stress on the valve element during valve operations, and thus increases valve element lifetime, as compared to present diverter valves.

In one embodiment, and by way of example only, a hot gas diverter valve includes a housing, a first fluid inlet port, a second fluid inlet port, a first fluid outlet port, a second fluid outlet port, first and second inner valve seats, first and second outer valve seats, and a valve element. The housing has a valve bore formed therein. The first fluid inlet port extends through the housing and is in fluid communication with the valve bore. The second fluid inlet port extends through the housing and is in fluid communication with the valve bore. The first fluid outlet port extends through the housing and is in fluid communication with the valve bore. The second fluid outlet port extends through the housing and is in fluid communication with the valve bore. The first inner valve seat is disposed within the valve bore and surrounds the first fluid outlet port. The second inner valve seat is disposed within the valve bore and surrounds the second fluid outlet port. The first outer valve seat is disposed within the valve bore, and surrounds, and is spaced apart from, the first inner valve seat to form a first flow channel therebetween. The second outer valve seat is disposed within the valve bore, and surrounds, and is spaced apart from, the second inner valve seat to form a second flow channel therebetween. The valve element is freely disposed within the valve bore and is translationally moveable between at least a first position, in which the valve element substantially seats against the first inner and first outer valve seats, and a second position, in which the valve element seats against the second inner and second outer valve seats.

In another exemplary embodiment, a flow control device for use with a hot gas generator having a pressure vessel and providing a combustion gas output includes a fluidic amplifier, and a diverter valve. The fluidic amplifier has a fluid inlet port and at least two fluid outlet ports. The fluid inlet port is adapted to receive hot pressurized fluid from the gas generator pressure vessel. The diverter valve includes a housing, a first fluid inlet port, a second fluid inlet port, a first fluid outlet port, a second fluid outlet port, first and second inner valve seats, first and second outer valve seats, and a valve element. The housing has a valve bore formed therein. The first fluid inlet port extends through the housing and couples a first one of the fluidic amplifier fluid outlet ports in fluid communication with the valve bore. The second fluid inlet port extends through the housing and couples a second one of the fluidic amplifier fluid outlet ports in fluid communication with the valve bore. The diverter valve first fluid outlet port extends through the housing and is in fluid communication with the valve bore. The diverter valve second fluid outlet port extends through the housing and is in fluid communication with the valve bore. The first inner valve seat is disposed within the valve bore and surrounds the first fluid outlet port. The second inner valve seat is disposed within the valve bore and surrounds the second fluid outlet port. The first outer valve seat is disposed within the valve bore, and surrounds, and is spaced apart from, the first inner valve seat to form a first flow channel therebetween. The second outer valve seat is disposed within the valve bore, and surrounds, and is spaced apart from, the second inner valve seat to form a second flow channel therebetween. The valve element is freely disposed within the valve bore and is translationally moveable between at least a first position, in which the valve element substantially seats against the first inner and first outer valve seats, and a second position, in which the valve element seats against the second inner and second outer valve seats.

In yet another exemplary embodiment, a flight control system includes a controller a hot gas generator, one or more fluidic amplifier stages, at least two discharge nozzles, and a diverter valve. The controller is operable to supply flight control signals. The hot gas generator is operable to supply a flow of hot pressurized gas. The fluidic amplifier stages are coupled to receive the flow of hot pressurized gas from the gas generator and are responsive to the flight control signals to selectively divert at least a portion of the received flow of hot pressurized gas into one of at least two amplifier stage outlet ports. The diverter valve includes a housing, a first fluid inlet port, a second fluid inlet port, a first fluid outlet port, a second fluid outlet port, first and second inner valve seats, first and second outer valve seats, and a valve element. The housing has a valve bore formed therein. The first fluid inlet port extends through the housing and couples a first one of the fluidic amplifier fluid outlet ports in fluid communication with the valve bore. The second fluid inlet port extends through the housing and couples a second one of the fluidic amplifier fluid outlet ports in fluid communication with the valve bore. The diverter valve first fluid outlet port extends through the housing and is in fluid communication with the valve bore. The diverter valve second fluid outlet port extends through the housing and is in fluid communication with the valve bore. The first inner valve seat is disposed within the valve bore and surrounds the first fluid outlet port. The second inner valve seat is disposed within the valve bore and surrounds the second fluid outlet port. The first outer valve seat is disposed within the valve bore, and surrounds, and is spaced apart from, the first inner valve seat to form a first flow channel therebetween. The second outer valve seat is disposed within the valve bore, and surrounds, and is spaced apart from, the second inner valve seat to form a second flow channel therebetween. The valve element is freely disposed within the valve bore and is translationally moveable between at least a first position, in which the valve element substantially seats against the first inner and first outer valve seats, and a second position, in which the valve element seats against the second inner and second outer valve seats.

Other independent features and advantages of the preferred diverter valve will become apparent from the following detailed description, taken in conjunction with the accompanying drawings which illustrate, by way of example, the principles of the invention.

DETAILED DESCRIPTION OF A PREFERRED EMBODIMENT

Figure 1:
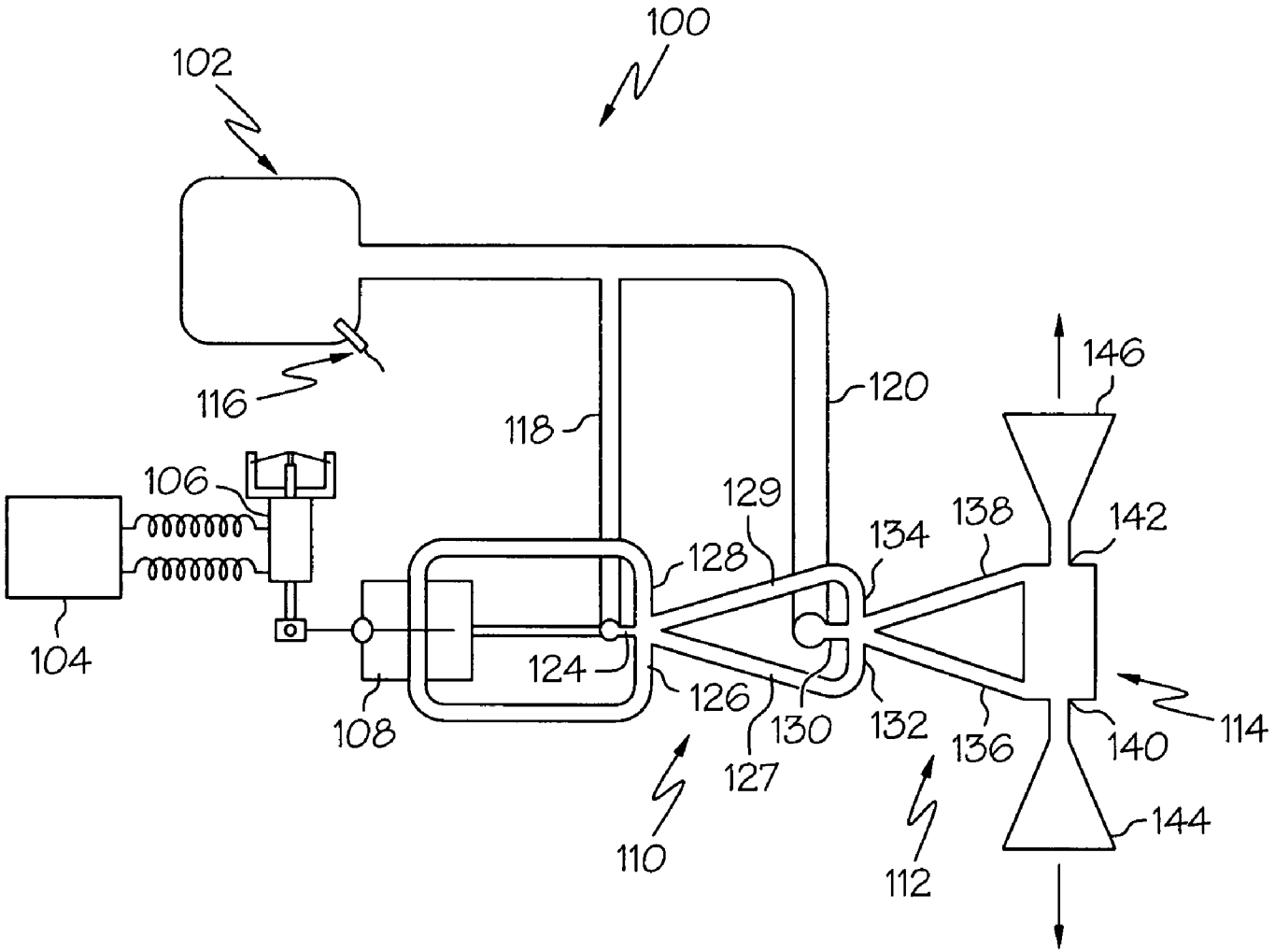
FIG. 1 is a simplified schematic diagram of an exemplary flight control system that may use an embodiment of the present invention.

A simplified schematic diagram of at least a portion of an exemplary flight control system 100 that may use an embodiment of the present invention is illustrated in FIG. 1. The system 100 includes a gas generator 102, a flight controller 104, a solenoid valve 106, a pilot valve 108, a first stage fluidic amplifier 110, a second stage fluidic amplifier 112, and a diverter valve 114. The gas generator 102 includes initiators 1116 that, during a vehicle launch sequence or at some point during vehicle flight, activates the gas generator 102. The gas generator 102, upon activation, supplies a flow of high pressure, high temperature gas to one or more gas flow paths. In the depicted embodiment, a first gas flow path 118 is fluidly coupled to the first stage fluidic amplifier 110 and to the pilot valve 108, and a second gas flow path 120 is fluidly coupled to the second stage fluidic amplifier 112.

The first 110 and second 112 stage fluidic amplifiers are each preferably non-vented fluidic bistable amplifiers. The first stage fluidic amplifier 110 includes a primary gas flow path 124, two control gas flow paths, namely a first control gas flow path 126 and a second control gas flow path 128, and two fluid outlet ports, namely a first fluid outlet port 127 and a second fluid outlet port 129. Similarly, the second stage fluidic amplifier 112 includes a primary gas flow path 130, a first control gas flow path 132, a second control gas flow path 134, a first fluid outlet port 136, and a second fluid outlet port 138.

The first stage fluidic amplifier primary gas flow path 124 is in fluid communication with the first gas flow path 1118 from the gas generator 102, and the second stage fluidic amplifier primary gas flow path 130 is in fluid communication with the second gas flow path 120 from the gas generator 102. The first stage fluidic amplifier first 126 and second 128 control gas flow paths are in fluid communication with the pilot valve 108, and the second stage fluidic amplifier first 132 and second 134 control gas flow paths are in fluid communication with the first stage fluidic amplifier first 127 and second 129 fluid outlet ports, respectively. The second stage fluidic amplifier first 136 and second 138 fluid outlet ports are in fluid communication with the diverter valve 114.

Figure 2:
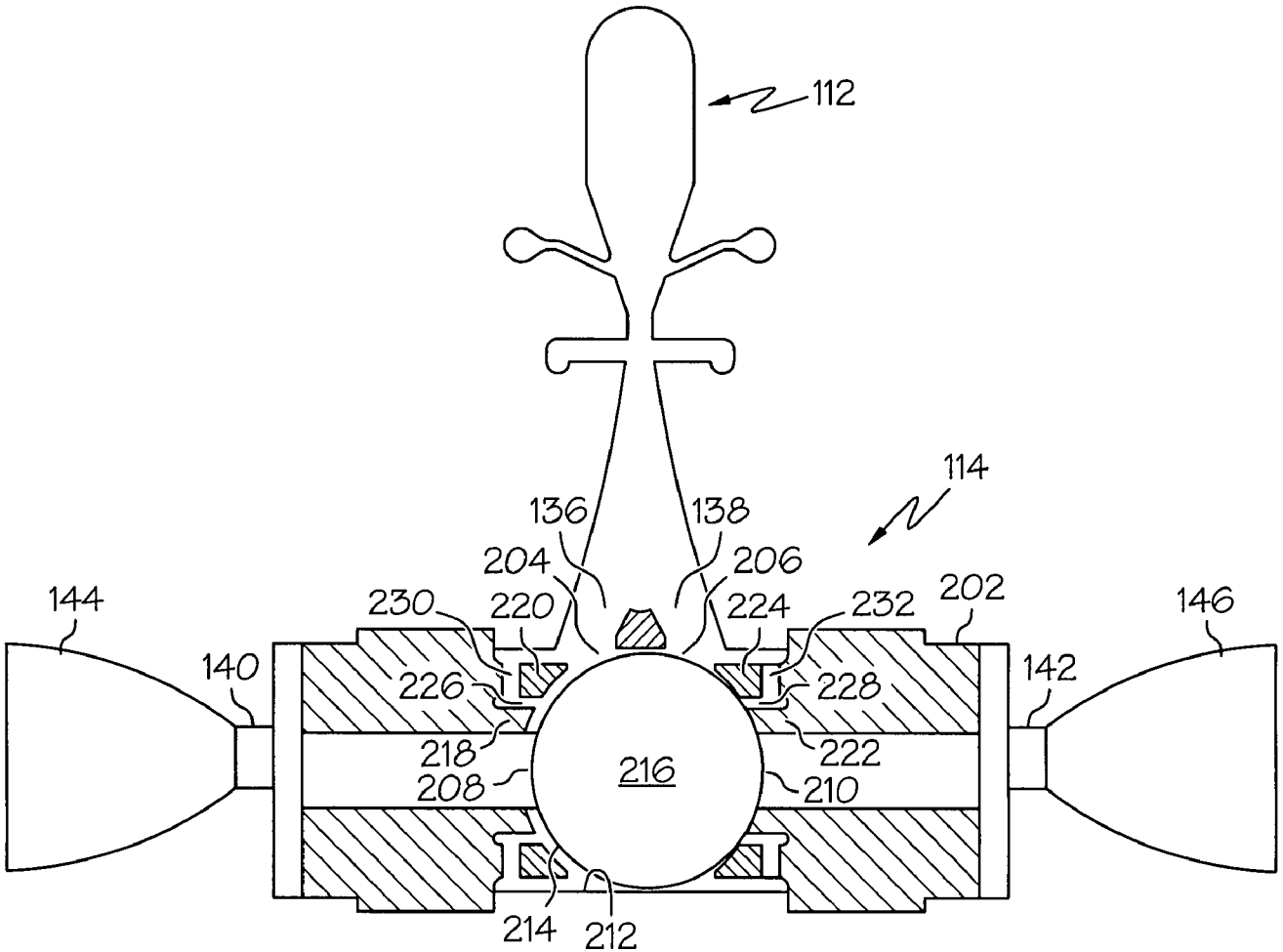
FIG. 2 is a cross section view of a portion of the flight control system of FIG. 1, showing an exemplary fluidic diverter valve according to an exemplary embodiment of the present invention.

The diverter valve 114, a particular embodiment of which is shown in cross section in FIG. 2, is mounted to the second stage fluidic amplifier 112. In the depicted embodiment, the diverter valve 114 is mounted within the second stage fluidic amplifier 112, though it will be appreciated that the diverter valve 114 could be mounted on the second stage fluidic amplifier 112. As FIG. 2 illustrate, the diverter valve 114 includes a housing 202, at least two fluid inlet ports, a first fluid inlet port 204 and a second fluid inlet port 206, and at least two fluid outlet ports, a first fluid outlet port 208 and a second fluid outlet port 210. It will be appreciated that the configuration of the first 204 and second 206 fluid inlet ports and the first 208 and second 210 fluid outlet ports is not limited to that depicted in FIG. 2. Moreover, the housing 202 may be formed from two or more separate sections or as an integral piece. In either case, an inner surface 212 of the housing 202 defines a valve bore 214 that is preferably, though not necessarily, cylindrically shaped, and in which a valve element 216 is freely disposed. The valve element 216 is preferably, though not necessarily, spherically shaped, and is translationally moveable within the valve bore 214 between the first 208 and second 210 fluid outlet ports.

As FIG. 2 additionally shows, a plurality of valve seats are disposed within the valve bore 214 proximate each of the fluid outlet ports 208, 210. In the depicted embodiment, this plurality of valve seats includes a first inner valve seat 218, a first outer valve seat 220, a second inner valve seat 222, and a second outer valve seat 224. The first inner 218 and first outer 220 valve seats are disposed proximate the first fluid outlet port 208, and the second inner 222 and second outer 224 valve seats are disposed proximate the second fluid outlet port 210. In particular, as FIG. 2 shows, the first inner valve seat 218 preferably surrounds the first fluid outlet port 208, and the first outer valve seat 220 at least partially surrounds the first inner valve seat 218. Similarly, the second inner valve seat 222 preferably surrounds the second fluid outlet port 210, and the second outer valve seat 224 at least partially surrounds the second inner valve seat 222. It will be appreciated that although two valve seats per fluid outlet port are shown, the diverter valve 114 could be constructed with more than this number of valves seats. The configuration that includes two valve seats per outlet is merely exemplary of a particular preferred embodiment.

As FIG. 2 additionally shows, a first flow channel 226 is formed between the first inner 218 and first outer 220 valve seats, and a second flow channel 22.8 is formed between the second inner 222 and outer 224 valve seats 222. The first 226 and second 228 flow channels are each in fluid communication with one of the fluid inlet ports 204, 206, and the valve bore 214. In particular, the first flow channel 226 is in fluid communication with the first fluid inlet port 204 and the valve bore 214, and the second flow channel 228 is in fluid communication with the second fluid inlet port 206 and the valve bore 214. It will be appreciated that the first 226 and second 228 flow channels may be formed in any one of numerous ways and configurations that provide sufficient pressure and flow during switching initialization. Some non-limiting examples of flow channels include one or more grooves, or a series of holes of the same or varying sizes. Thus, the first 226 and second 228 flow channels could be each be either a single flow channel or a plurality of flow channels.

Although the first 226 and second 228 flow channels could be placed in fluid communication with the first 204 and second 206 fluid inlet ports, respectively, in any one of numerous ways, it is preferably done so by forming a plurality of openings 230, 232. It will be appreciated that the number and configuration of the openings 230, 232 could vary. However, in a particular preferred embodiment, about eight evenly spaced holes are formed in the valve outer valve seats 220 and 224. No matter how the the first 226 and second 228 flow channels or openings 230, 232 are formed, it will be appreciated that each flow channel 226, 228 provides proper pressurization of the valve element 216 during switching initialization, when the valve element 216 is initially seated against the first inner 218 and first outer 220 valve seats, or against the second inner 222 and second outer 224 valve seats, respectively.

Each of the valve seats 218–224 is preferably shaped and dimensioned to allow the valve element 216 to seat against it, and seal the respective fluid outlet ports 208, 210. The valve seats 218–224 are also shaped and dimensioned to provide a relatively small clearance between the valve element 216 and the valve bore 214, when the valve element 216 is positioned proximate each of the valve seats 222, 224. However, it will be appreciated that the diverter valve 114 could be implemented with differently shaped valve seats 222, 224 and a differently shaped valve element 216 than what is depicted and described herein.

The diverter valve first 204 and second 206 fluid inlet ports and first 208 and second 210 fluid outlet ports each extend through the housing 202, and are each in fluid communication with the valve bore 214. The diverter valve first 204 and second 206 fluid inlet ports are also in fluid communication with the second stage fluidic amplifier first 136 and second 138 fluid outlet ports, respectively. In addition, the diverter valve first 208 and second 210 fluid outlet ports are in fluid communication with first 140 and second 142 blast tubes, respectively, which are each in fluid communication with first 144 and second 146 thrust nozzles, respectively. Thus, as will be described more fully below, the valve element 216 is positioned within the valve bore 214 by controlling the flow of fluid such as, for example, hot pressurized gas, through the second stage fluidic amplifier first 136 and second 138 fluid outlet ports.

Referring now to FIGS. 1 and 2 in combination, operation of the flight control system 100 is controlled by the flight controller 104. During vehicle flight, the flight controller 104 supplies control signals to the solenoid valve 106, which in turn causes the pilot valve 108 to divert a portion of the gas flowing in the first flow path 1118 into one of the first stage fluidic amplifier control gas flow paths 126 or 128. This causes the gas flowing through the first stage fluidic amplifier primary gas flow path 124 to be directed into one of the second stage fluidic amplifier control gas flow paths 132 or 134. This in turn causes the gas flowing through the second stage fluidic amplifier primary gas flow path 130, which is received from the gas generator second gas flow path 120, to be directed into one of the second stage fluidic amplifier outlet ports 136 or 138. As a result, gas flowing through the second stage fluidic amplifier outlet ports 136 or 138 will enter one of the diverter valve fluid inlet ports 204 or 206, into and through the plurality of openings 230 or 232, and into and through one of the flow channels 226 or 228. This will cause the valve element 216 to move away from one of the inner and outer valve seats 218, 220 or 222, 224, and thus one of the diverter valve fluid outlet ports 208 or 210, which will allow gas to flow through it to one of the thrust nozzles 144 or 146. At the same time, the valve element 216 will be moved toward the other inner and outer valve seats 222, 224 or 218, 220, and thus the other fluid outlet port 210 or 208, sealing it and the other thrust nozzle 146 or 144 from the gas flow.

For example, if it is desired to exhaust gas out the first thrust nozzle 144, the flight controller 104 will supply a control signal to solenoid valve 106 that will cause the pilot valve 108 to divert gas flow into the first stage fluidic amplifier first control gas flow path 126. This will direct the gas flowing through the first stage fluidic amplifier primary gas flow path 124 into the second stage fluidic amplifier second control gas flow path 134, which will in turn direct the gas flowing through the second stage fluidic amplifier primary gas flow path 130 into the second stage fluidic amplifier first outlet port 136. The gas then flows through the second stage fluidic amplifier first fluid outlet port 136, and into the diverter valve first fluid inlet port 204. As a result, the gas flow will move the valve element 216 off the first inner 218 and first outer 220 valve seats, away from the diverter valve first fluid outlet port 208, and toward the diverter valve second fluid outlet port 210. This will allow pressurized gas to flow out the diverter valve first outlet port 208, and the valve element 216 will seat against the second inner 222 and second outer 224 valve seats, which will seal the diverter valve second fluid outlet port 210. Thus, pressurized gas flows through the first thrust nozzle 144, while sealing the second thrust nozzle 146 against the gas flow.

The diverter valve 114 may be constructed of any one of numerous materials that are capable of withstanding the high temperature output of the gas generator 102, and the specific materials used may depend on the temperature of the gas supplied by the gas generator 102. For example, when the flight control system 100 need only supply relatively "warm" gas (e.g., ≦2000° F.) for relatively short flight profiles (e.g., <1 second), stainless steel may be used for the housing 202 and other non-moving parts of the diverter valve 114. For longer flight profiles, or hotter gas temperatures, the housing 202 and other non-moving parts are preferably constructed of Inconel, ceramic, or TZM (Titanium Zirconium Molybdenum). When the flight control system supplies gas at temperatures in the range of 3700° F., exotic materials such as, for example, rhenium, are preferred because of the high temperature strength and diffusion bonding capability such exotic materials exhibit. Conventional machining operations such as, for example, plunge EDM are suitable for forming the housing 202 and other non-moving parts.

The valve element 216 may also be constructed of any one of numerous materials that are capable of withstanding the high temperature output of the gas generator 102. In a particular preferred embodiment for warm gas applications, the valve element 216 is formed of a pure silicon nitride. For higher temperature applications, the valve element 216 is formed of a ceramic or graphite material, and is then coated with a layer of rhenium by, for example, a chemical vapor deposition (CVD) process.

The diverter valve 114 includes a valve bore 214 having a set of valve seats 218, 220 and 222, 224 associated with each fluid outlet port 208 and 210, respectively. Each set of valve seats 218, 220 and 222, 224 is at least partially separated from one another by a flow channel 226 and 228, respectively. The valve seat configuration increases the impact area for the valve element 216. In one particular preferred embodiment, in which each of the inner valve seats 218, 222 has an inner diameter of 0.120 inches and an outer diameter of 0.180 inches, and each of the outer valve seats 220, 224 has in inner diameter of 0.200 inches and an outer diameter of 0.310 inches, the total valve element impact area increased by approximately 150% relative to previous valves with only a single valve seat per outlet port that each have the inner and outer dimensions of just the inner valve seats 218, 222. As a result, the impact force upon seating against the valve seats is reduced a by about the same magnitude. Moreover, by including the flow channels 226 and 228 between the sets of valve seats 218, 220 and 222, 224, respectively, the switching force and performance of the valve element 216 is not adversely affected. This improved configuration also allows for the use of a heavier valve element 216, which can provide a more robust valve 114.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A hot gas diverter valve, comprising:

a housing having an inner surface that forms a valve bore therein;

a first fluid inlet port extending through the housing and in fluid communication with the valve bore;

a second fluid inlet port extending through the housing and in fluid communication with the valve bore;

a first fluid outlet port extending through the housing and in fluid communication with the valve bore;

a second fluid outlet port extending through the housing and in fluid communication with the valve bore;

a first inner valve seat disposed within the valve bore and surrounding the first fluid outlet port;

a second inner valve seat disposed within the valve bore and surrounding the second fluid outlet port;

a first outer valve seat disposed within the valve bore, the first outer valve seat at least partially surrounding, and at least partially spaced apart from, the first inner valve seat to form a first flow channel therebetween;

a second outer valve seat disposed within the valve bore, the second outer valve seat at least partially surrounding, and at least partially spaced apart from, the second inner valve seat to form a second flow channel therebetween; and a valve element freely disposed within the valve bore and translationally moveable between at least (i) a first position, in which the valve element seats against the first inner and first outer valve seats, and (ii) a second position, in which the valve element seats against the second inner and second outer valve seats.

2. The diverter valve of claim 1, wherein:

the first flow channel is in fluid communication with the first inlet port and the valve bore; and the second flow channel is in fluid communication with the second inlet port and the valve bore.

3. The diverter valve of claim 1, wherein the valve element is substantially sphere-shaped.

4. The diverter valve of claim 3, wherein:

the first and second inner seats and the first and second outer seats are at least partially sphere-shaped.

5. The diverter valve of claim 1, wherein the first and second fluid outlet ports are positioned substantially opposite one another.

6. The diverter valve of claim 1, wherein the housing comprises a metal selected from the group consisting of Inconel, ceramic, and Titanium Zirconium Molybdenum.

7. The diverter valve of claim 1, wherein the housing further comprises rhenium.

8. The diverter valve of claim 1, wherein the valve element comprises silicon nitride.

9. The diverter valve of claim 1, wherein the valve element comprises graphite coated with a layer of rhenium.

10. A flow control device for use with a hot gas generator having a pressure vessel and providing a combustion gas output, the flow control device comprising:

a fluidic amplifier having a fluid inlet port and at least two fluid outlet ports, the fluid inlet port adapted to receive hot pressurized fluid from the gas generator pressure vessel; and a diverter valve including:

a housing having an inner surface that forms a valve bore therein, the valve bore including a first end and a second end, a first fluid inlet port extending through the housing and in fluid communication with the valve bore, a second fluid inlet port extending through the housing and in fluid communication with the valve bore, a first fluid outlet port extending through the housing and in fluid communication with the valve bore first end, a second fluid outlet port extending through the housing and in fluid communication with the valve bore second end, a first inner valve seat disposed within the valve bore and surrounding the first fluid outlet port, a second inner valve seat disposed within the valve bore and surrounding the second fluid outlet port, a first outer valve seat disposed within the valve bore, the first outer valve seat surrounding, and spaced apart from, the first inner valve seat to form a first flow channel therebetween, a second outer valve seat disposed within the valve bore, the second outer valve seat surrounding, and spaced apart from, the second inner valve seat to form a second flow channel therebetween, and a valve element freely disposed within the valve bore and translationally moveable between at least (i) a first position, in which the valve element seats against the first inner and first outer valve seats, and (ii) a second position, in which the valve element seats against the second inner and second outer valve seats.

11. The device of claim 10, wherein:

the first flow channel is in fluid communication with the first inlet port and the valve bore; and the second flow channel is in fluid communication with the second inlet port and the valve bore.

12. The device of claim 10, wherein the valve element is substantially sphere-shaped.

13. The device of claim 12, wherein:

the first and second inner seats and the first and second outer seats are at least partially sphere-shaped.

14. The device of claim 10, wherein the first and second fluid outlet ports are positioned substantially opposite one another.

15. The device of claim 10, wherein the housing comprises a metal selected from the group consisting of Inconel, ceramic, and Titanium Zirconium Molybdenum.

16. The device of claim 15, wherein the housing further comprises rhenium.

17. The device of claim 10, wherein the valve element comprises silicon nitride.

18. The device of claim 10, wherein the valve element comprises graphite coated with a layer of rhenium.

19. A flight control system, comprising:

a controller operable to supply flight control signals;

a hot gas generator operable to supply a flow of hot pressurized gas;

one or more fluidic amplifier stages coupled to receive the flow of hot pressurized gas from the gas generator and responsive to the flight control signals to selectively divert at least a portion of the received flow of hot pressurized gas into one of at least two amplifier stage outlet ports;

at least two discharge nozzles; and a diverter valve including:

a first fluid inlet port extending through the housing and in fluid communication with the valve bore, a second fluid inlet port extending through the housing and in fluid communication with the valve bore, a first fluid outlet port extending through the housing and in fluid communication with the valve bore first end, a second fluid outlet port extending through the housing and in fluid communication with the valve bore second end, a first inner valve seat disposed within the valve bore and surrounding the first fluid outlet port, a second inner valve seat disposed within the valve bore and surrounding the second fluid outlet port, a first outer valve seat disposed within the valve bore, the first outer valve seat surrounding, and spaced apart from, the first inner valve seat to form a first flow channel therebetween, a second outer valve seat disposed within the valve bore, the second outer valve seat surrounding, and spaced apart from, the second inner valve seat to form a second flow channel therebetween, and a valve element freely disposed within the valve bore and translationally moveable between at least (i) a first position, in which the valve element seats against the first inner and first outer valve seats, and (ii) a second position, in which the valve element seats against the second inner and second outer valve seats.

20. The system of claim 19, wherein:

the first flow channel is in fluid communication with the first inlet port and the valve bore; and the second flow channel is in fluid communication with the second inlet port and the valve bore.

* * * * *